US008492066B2

(12) United States Patent
Lai et al.

(10) Patent No.: US 8,492,066 B2
(45) Date of Patent: Jul. 23, 2013

(54) TONER COMPOSITIONS AND PROCESSES

(75) Inventors: Zhen Lai, Webster, NY (US);
Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 228 days.

(21) Appl. No.: 13/052,385

(22) Filed: Mar. 21, 2011

(65) Prior Publication Data

US 2012/0244470 A1 Sep. 27, 2012

(51) Int. Cl.
*G03G 9/087* (2006.01)

(52) U.S. Cl.
USPC ..... 430/137.14; 430/109.4

(58) Field of Classification Search
USPC ..... 430/137.14, 109.4
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,847,604 | A | 11/1974 | Hagenbach et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 6,004,714 | A | 12/1999 | Ciccarelli |
| 6,190,815 | B1 | 2/2001 | Ciccarelli et al. |
| 6,593,049 | B1 | 7/2003 | Veregin et al. |
| 6,743,559 | B2 | 6/2004 | Combes et al. |
| 6,756,176 | B2 | 6/2004 | Stegamat et al. |
| 6,830,860 | B2 | 12/2004 | Sacripante et al. |
| 7,029,817 | B2 | 4/2006 | Robinson et al. |
| 7,329,476 | B2 | 2/2008 | Sacripante et al. |
| 7,736,831 | B2 | 6/2010 | Lai et al. |
| 2002/0098433 | A1* | 7/2002 | Matsunaga et al. ..... 430/108.8 |
| 2004/0072087 | A1* | 4/2004 | Matsunaga et al. ..... 430/45 |
| 2006/0216626 | A1 | 9/2006 | Sacripante et al. |
| 2006/0240353 | A1* | 10/2006 | Matsumura et al. ..... 430/109.4 |
| 2007/0224530 | A1* | 9/2007 | Kobori et al. ..... 430/100 |
| 2008/0038655 | A1* | 2/2008 | Kidokoro ..... 430/111.4 |
| 2008/0063965 | A1* | 3/2008 | Lai et al. ..... 430/108.1 |
| 2008/0107990 | A1 | 5/2008 | Field et al. |
| 2008/0236446 | A1 | 10/2008 | Zhou et al. |
| 2008/0247788 | A1* | 10/2008 | Ayaki et al. ..... 399/321 |
| 2009/0047593 | A1 | 2/2009 | Vanbesien et al. |
| 2009/0074450 | A1* | 3/2009 | Nagayama et al. ..... 399/111 |
| 2010/0015544 | A1* | 1/2010 | Agur et al. ..... 430/108.23 |
| 2010/0068646 | A1* | 3/2010 | Yamamoto ..... 430/124.1 |
| 2010/0310984 | A1* | 12/2010 | Nosella et al. ..... 430/137.14 |
| 2011/0003243 | A1* | 1/2011 | Sacripante et al. ..... 430/109.4 |
| 2011/0052882 | A1* | 3/2011 | Gong et al. ..... 428/195.1 |

* cited by examiner

*Primary Examiner* — Hoa V Le
(74) *Attorney, Agent, or Firm* — MDIP LLC

(57) ABSTRACT

Processes for producing toners are provided. The processes include emulsion aggregation processes, whereby a reactive coalescent is utilized in the coalescence step to coalesce aggregated particles, thereby forming toner particles. The resulting toners may be highly pigmented, and may possess low melt characteristics.

20 Claims, No Drawings

TONER COMPOSITIONS AND PROCESSES

BACKGROUND

This disclosure is generally directed to toner processes, and more specifically, emulsion aggregation and coalescence processes, as well as toner compositions formed by such processes.

Toner blends containing crystalline or semi-crystalline polyester resins with an amorphous resin have recently been shown to provide very desirable ultra low melt fusing, which is important for both high-speed printing and lower fuser power consumption. These types of toners containing crystalline polyesters have been demonstrated suitable for both emulsion aggregation (EA) toners, and in conventional jetted toners. Combinations of amorphous and crystalline polyesters may provide toners with relatively low-melting point characteristics (sometimes referred to as low-melt, ultra low melt, or ULM), which allows for more energy-efficient and faster printing.

Emulsion aggregation/coalescing processes for the preparation of toners are illustrated in a number of patents, such as U.S. Pat. Nos. 5,290,654, 5,278,020, 5,308,734, 5,344,738, 6,593,049, 6,743,559, 6,756,176, 6,830,860, 7,029,817, and 7,329,476, and U.S. Patent Application Publication Nos. 2006/0216626, 2008/0107990, 2008/0236446, and 2009/0047593. The disclosures of each of the foregoing patents are hereby incorporated by reference in their entirety.

To produce thinner toner layers on prints, it may be desirable to increase the pigment loading in these toners. The resulting toners, sometimes referred to as "highly pigmented" toners, may be more economical than conventional EA toners, as lower amounts of toner may be required to obtain quality images. However, the high pigment loading may make it difficult to achieve the desired particle shape (circularity). In addition, longer times for forming the particles and higher coalescence temperatures may be required.

Improved methods for producing toner particles, reducing the time and cost involved in producing the toner particles, remain desirable.

SUMMARY

The present disclosure provides processes for producing toners, as well as the toners produced by these processes. In embodiments, a process of the present disclosure includes contacting at least one amorphous resin in an emulsion, at least one crystalline resin in an emulsion, a colorant dispersion, and a wax to form a mixture; aggregating the mixture to form aggregated particles; adding a reactive coalescent agent such as benzoic acid alkyl esters, ester-alcohols, glycol-ether type solvents, long-chain aliphatic alcohols, aromatic alcohols, and mixtures thereof to the aggregated particles; allowing the aggregated particles to coalesce for a period of time of from about 10 minutes to about 300 minutes to form toner particles; and recovering the toner particles, wherein the toner particles are highly pigmented particles possessing the colorant in an amount of from about 1 percent by weight to about 15 percent by weight of the toner particles.

In other embodiments, a process of the present disclosure includes contacting at least one amorphous resin in an emulsion, at least one crystalline resin in an emulsion, a colorant dispersion, and a wax to form a mixture; aggregating the mixture in the presence of an aggregating agent such as polyaluminum halides, polyaluminum silicates, and water soluble aluminum salts, to form aggregated particles; adding a reactive coalescent agent such as benzoic acid alkyl esters, ester-alcohols, glycol-ether type solvents, long-chain aliphatic alcohols, aromatic alcohols, and mixtures thereof to the aggregated particles; allowing the aggregated particles to coalesce for a period of time of from about 10 minutes to about 300 minutes to form toner particles; and recovering the toner particles, wherein the toner particles are highly pigmented particles possessing the colorant in an amount of from about 1 percent by weight to about 15 percent by weight of the toner particles, and wherein the toner particles possess a melting point of from about 50° C. to about 100° C.

In other embodiments, a process of the present disclosure includes contacting at least one amorphous resin in an emulsion, at least one crystalline resin in an emulsion, a colorant dispersion, and a wax to form a mixture; aggregating the mixture in the presence of an aggregating agent such as polyaluminum halides, polyaluminum silicates, and water soluble aluminum salts, to form aggregated particles; adding a reactive coalescent agent including a benzoic acid alkyl ester such as decyl benzoate, isodecyl benzoate, nonyl benzoate, isononyl benzoate, octyl benzoate, isooctyl benzoate, 2-ethylhexyl benzoate, tridecyl or isotridecyl benzoate, 3,7-dimethyloctyl benzoate, 3,5,5-trimethylhexyl benzoate, and combinations thereof, to the aggregated particles; allowing the aggregated particles to coalesce for a period of time of from about 10 minutes to about 300 minutes to form toner particles; and recovering the toner particles, wherein the toner particles are highly pigmented particles possessing the colorant in an amount of from about 1 percent by weight to about 15 percent by weight of the toner particles, and wherein the toner particles possess a melting point of from about 50° C. to about 100° C.

DETAILED DESCRIPTION

In accordance with the present disclosure, methods for producing ultra low melt (ULM) EA toners are provided. The toners may be formed from one or more amorphous resin emulsions, a crystalline resin emulsion, optionally a pigment, and optionally a wax. In embodiments, utilizing the methods of the present disclosure, highly pigmented toners may be produced which require less toner to obtain the same image. These highly pigmented toners may exhibit an increase in pigment loading of from about 30% to about 100% higher than nominal, in embodiments from about 35% to about 90% higher than nominal. The resulting toners, referred to herein, in embodiments, as highly pigmented toners, reduce the toner mass per unit area (TMA) on a print formed with such a toner, resulting in a thinner toner layer. The thinner toner layer, using less toner, is thus less expensive. The thinner toner layers also result in more of an offset look and feel for the print, as offset inks produce thin image layers on the print.

The toner may also possess low melting properties. That is, the toner may be an ultra low melt toner. As used herein, ultra low melt toners display a melting point of from about 50° C. to about 100° C., in embodiments from about 60° C. to about 90° C.

Resin

Any toner resin may be utilized in the toners and processes of the present disclosure. Such resins, in turn, may be made of any suitable monomer or monomers via any suitable polymerization method. In embodiments, the resin may be prepared by emulsion polymerization. In further embodiments, the resin may be prepared by a method other than emulsion polymerization, such as condensation polymerization.

In embodiments, suitable resins may be polyester resins. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, a resin utilized in forming a toner may include an amorphous polyester resin. In embodiments, the resin may be a polyester resin formed by reacting a diol with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be present in an amount of from about 1 to about 10 mole percent of the resin.

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester may be present, for example, from about 45 to about 52 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly(propoxylated bisphenol A co-dodecylsuccinate), and combinations thereof. In embodiments, the amorphous resin may be linear.

In embodiments, a suitable amorphous resin may include alkoxylated bisphenol A fumarate/terephthalate based polyesters and copolyester resins. In embodiments, a suitable amorphous polyester resin may be a copoly(propoxylated bisphenol A co-fumarate)-copoly(propoxylated bisphenol A co-terephthalate) resin having the following formula (I):

(I)

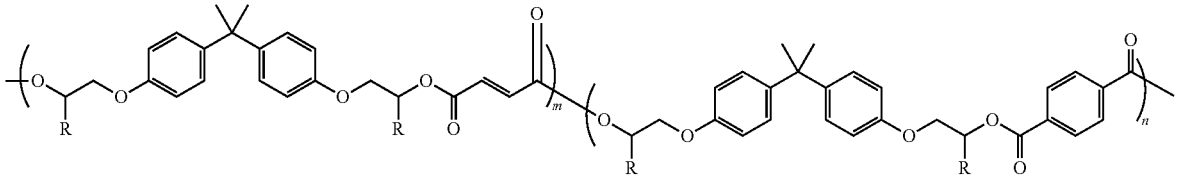

wherein R may be hydrogen or a methyl group, and m and n represent random units of the copolymer and m may be from about 2 to 10, and n may be from about 2 to 10.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexylene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly (ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, or sodio sulfonated, if desired.

The amorphous polyester resin may be a branched resin. As used herein, the terms "branched" or "branching" includes branched resins and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and diols.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature of from about 58.5° C. to about 66° C., in embodiments from about 60° C. to about 62° C.

The low molecular weight amorphous resin may possess a softening point of from about 105° C. to about 118° C., in embodiments from about 107° C. to about 109° C.

The low molecular weight amorphous polyester resins may have an acid value of from about 8 to about 20 mg KOH/g, in embodiments from about 9 to about 16 mg KOH/g, and in embodiments from about 11 to about 15 mg KOH/g.

In embodiments, a low molecular weight amorphous polyester resin may include alkoxylated bisphenol A with terephthalic acid, fumaric acid, and dodecenylsuccinic acid co-monomers.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 45,000, for example, from about 45,000 to about 150,000, in embodiments from about 50,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$).

The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 53° C. to about 58° C., in embodiments from about 54.5° C. to about 57° C.

In embodiments, a high molecular weight amorphous resin may include alkoxylated bisphenol A with terephthalic acid, trimellitic acid, and dodecenylsuccinic acid co-monomers.

The amorphous resin(s) is generally present in the toner composition in various suitable amounts, such as from about 60 to about 90 weight percent, in embodiments from about 50 to about 65 weight percent, of the toner or of the solids.

In further embodiments, the amorphous resin(s) may have a melt viscosity of from about 10 to about 1,000,000 Pa*S at about 130° C., in embodiments from about 50 to about 100,000 Pa*S.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 25 percent by weight of the toner components, in embodiments from about 6 to about 15 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_w$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Publication Nos. 2006/0216626, 2008/0107990, 2008/0236446 and 2009/0047593, the disclosures of each of which are hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

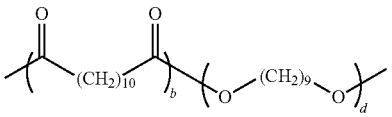

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), polypropylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly(tetramethylene trithiodicarboxylate), poly(trimethylene dodecane dioate), poly(m-xylene), poly(p-xylylene pimelamide), and combinations thereof.

As noted above, in embodiments a toner of the present disclosure may also include at least one high molecular weight amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As noted above, in embodiments, the resin may be formed by emulsion polymerization methods. Utilizing such methods, the resin may be present in a resin emulsion, which may then be combined with other components and additives to form a toner of the present disclosure.

Toner

The resins described above, in embodiments a combination of polyester resins, for example a low molecular weight amorphous resin, a high molecular weight amorphous resin, and a crystalline resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO290™, IGEPAL CA-210™, ANTAROX890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants which may be used, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, from about 0.1 to about 35 percent by weight of the toner, or from about 1 to about 15 weight percent of the toner, or from about 2 to about 12 percent by weight of the toner, in embodiments from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

In embodiments, toners of the present disclosure may have high pigment loadings. As used herein, high pigment loadings include, for example, toners having a colorant in an amount of from about 7 percent by weight of the toner to about 40 percent by weight of the toner, in embodiments from about 10 percent by weight of the toner to about 18 percent by weight of the toner. These high pigment loadings are important to achieve fully saturated colors with high chroma, and particularly to enable a good color match to certain colors such as PANTONE® Orange, Process Blue, PANTONE® yellow, and the like. (The PANTONE® colors refer to one of the most popular color guides illustrating different colors, wherein each color is associated with a specific formulation of colorants, and is published by PANTONE, Inc., of Moonachie, N.J.)

Wax

Optionally, a wax may also be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in, for example, U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion aggregation processes, such as a process that includes aggregating a mixture of an optional colorant, an optional wax, an optional coagulant, and any other desired or required additives, and emulsions including the resins described above, optionally in surfactants as described above, and then coalescing the aggregate mixture. A mixture may be prepared by adding an optional colorant and optionally a wax or other materials, which may also be optionally in a dispersion(s) including a surfactant, to the emulsion, which may be a mixture of two or more emulsions containing the resin(s). For example, emulsion/aggregation/coalescing processes for the preparation of toners are illustrated in the disclosure of the patents and publications referenced hereinabove.

The pH of the resulting mixture may be adjusted by an acid such as, for example, acetic acid, sulfuric acid, hydrochloric acid, citric acid, trifluoro acetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 weight percent by weight of water, in other embodiments, of from about 0.7 to about 5 weight percent by weight of water.

Examples of bases used to increase the pH and ionize the aggregate particles, thereby providing stability and preventing the aggregates from growing in size, can include sodium hydroxide, potassium hydroxide, ammonium hydroxide, cesium hydroxide and the like, among others.

Additionally, in embodiments, the mixture may be homogenized. If the mixture is homogenized, homogenization may be accomplished by mixing at a speed of from about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, combinations thereof, and the like.

Other suitable aggregating agents also include, but are not limited to, tetraalkyl titinates, dialkyltin oxide, tetraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof, and the like.

Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0.1 to about 10 weight percent, in embodiments from about 0.2 to about 8 weight percent, in other embodiments from about 0.5 to about 5 weight percent, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 90° C., in embodiments from about 45° C. to about 80° C., which may be below the glass transition temperature of the resin(s) utilized to form the toner particles.

Shell Resin

In embodiments, after aggregation, but prior to coalescence, a shell may be applied to the aggregated particles. Any resin described above as suitable for forming the core resin may be utilized as the shell. In embodiments, a polyester amorphous resin latex as described above may be included in the shell.

In embodiments, an amorphous resin which may be utilized to form a shell in accordance with the present disclosure includes an amorphous polyester, optionally in combination with an additional polyester resin latex. Multiple resins may thus be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Once the desired final size of the toner particles is achieved, the pH of the mixture may be adjusted with a base to a value from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

The particles may then be coalesced to the desired final shape, the coalescence being achieved by, for example, the addition of a reactive coalescent agent. Examples of reactive coalescent agents include, but are not limited to, benzoic acid alkyl esters, ester-alcohols, glycol-ether type solvents, long-chain aliphatic alcohols, aromatic alcohols, mixtures thereof, and the like. Examples of benzoic acid alkyl esters include benzoic acid alkyl esters where the alkyl group, which can be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, mixtures thereof, and the like. Commercial examples of such benzoic acid alkyl esters include VELTA® 262 (isodecyl benzoate) and VELTA® 368 (2-ethylhexyl benzoate), available from Vlesicol Chemical Corporation. Examples of ester-alcohols include hydroxyalkyl esters of alkanoic acids where the alkyls group, which can be straight or branched, substituted or unsubstituted, independently have from about 2 to about 30 carbon atoms, such as 2,2,4-trimethylpentane-1,3-diol monoisobutyrate. Commercial examples of such ester-alcohols include TEXANOL® (2,2,4-trimethylpentane-1,3-diol monoisobutyrate) available from Eastman Chemical Company. Examples of glycol-ether type solvents include diethylene glycol monomethylether acetate, diethylene glycol monobutylether acetate, butyl carbitol acetate (BCA), and the like. Examples of long-chain aliphatic alcohols include those where the alkyl group is from about 5 to about 20 carbon atoms, such as ethylhexanol, octanol, dodecanol, and the like. Examples of aromatic alcohols include benzyl alcohol, and the like.

In embodiments, the reactive coalescent agents fulfill the following criteria: (1) they sufficiently soften the polymer during the temperature ramp or the early stage of coalescence, so that the individual particles will combine to form a continuous film easily; (2) the reactive coalescent agent evaporates during later stages, so that it does not increase the total volatile organic content in the final toner product, and minimizes any impact on the machine performance; and (3) it is desirable that the reactive coalescent agent has very low solubility, such as below about 1 weight %, below about 0.5 weight %, below about 0.1 weight %, or below about 0.05 weight %, in water, so that most of the reactive coalescent agent can concentrate inside or on the surfaces of the particles.

In embodiments, the reactive coalescent agent evaporates during later stages of the emulsion aggregation process, such as during the second heating step which is generally above the glass transition temperature of the polymeric resin. The final toner particles are thus free of any remaining coalescent agent. To the extent that any remaining coalescent agent may be present in the final toner particles, the amount of remaining coalescent agent is such that it does not affect any properties or performance of the toner.

The coalescent agent can be added in any desired or suitable amount. For example, the coalescent agent can be added in an amount of from about 0.01 to about 10 percent by weight, based on the solids content in the reaction medium, in embodiments from about 0.05 to about 3 percent by weight, based on the solids content in the reaction medium, in embodiments from about 0.1 to about 0.5 percent by weight, based on the solids content in the reaction medium.

While the reactive coalescent agent can be added at any time between aggregation and coalescence, in embodiments it is desired to add the reactive coalescent agent after aggregation is "frozen" or completed by adjustment of pH by addition, for example, of a base as described above.

Additionally, coalescence may occur with heating the mixture to a temperature from about 45° C. to about 100° C., in embodiments from about 55° C. to about 99° C., which may be at or above the glass transition temperature of the resins utilized to form the toner particles, and/or reducing the stirring, for example to from about 100 revolutions per minute (rpm) to about 400 rpm, in embodiments from about 200 rpm to about 300 rpm. The fused particles can be measured for shape factor or circularity, such as with a Sysmex FPIA 2100 analyzer, until the desired shape is achieved.

In accordance with the present disclosure, it has been found that highly pigmented ULM toners may be formed with coalescence conducted in a shorter time, at a lower process temperature, or both. For example, while typical emulsion aggregation processes may conduct the coalescence step for a time from about 2 to about 5 hours at a temperature of about 96° C., incorporation of the reactive coalescent agent allows the coalescence to be conducted within about one hour at a temperature of about 94° C. In embodiments, the coalescence may take place over a period of time of from about 10 minutes to about 300 minutes, in embodiments from about 30 minutes to about 90 minutes.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter ($D_{50v}$), GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

Utilizing the methods of the present disclosure, aggregation of the toner particles may be adjusted based upon solids content, speed of mixing, and temperature for freezing to arrive at a desired amount of residual aluminum ions in the toner and thus desired gloss levels. Thus, for example, the gloss level of a toner of the present disclosure may have a peak gloss as measured on Color Xpressions Select (CXS) paper from XEROX Corporation, in Gardner Gloss Units (ggu) by a Gardner Gloss Meter at an angle of 75°, of from about 10 ggu to about 100 ggu, in embodiments from about 20 ggu to about 80 ggu.

In embodiments, toners of the present disclosure may be utilized as ultra low melt (ULM) toners. In embodiments, the dry toner particles, exclusive of external surface additives, may have the following characteristics:

(1) Volume average diameter of from about 2.5 to about 20 microns, in embodiments from about 2.75 to about 18 microns, in other embodiments from about 3 to about 15 microns.

(2) Number Average Geometric Standard Deviation (GSDn) and/or Volume Average Geometric Standard Deviation (GSDv) of from about 1.18 to about 1.35, in embodiments from about 1.20 to about 1.34.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) A minimum fixing temperature of from about 120° C. to about 160° C., in embodiments from about 130° C. to about 150° C.

Advantages using the reactive coalescent of the present disclosure include, but are not limited to: (1) lowering the coalescence temperature; (2) reducing the time for aggregation/coalescence; (3) allowing for better toner particle shape/morphology control; (4) improving toner performance; and (5) increasing productivity and reducing unit manufacturing cost (UMC) for the toner.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

Utilizing the methods of the present disclosure, highly pigmented toners may be produced which require less toner to obtain the same image. These highly pigmented toners may exhibit an increase in pigment loading of about 45% higher than nominal. Reducing the toner mass per unit area (TMA) on the print results in a thinner toner layer. To compensate for the reduced TMA, and still get the correct optical density, the loading of pigment in the toner should be increased proportionally to the TMA reduction, so that the total amount of pigment in the image layer is the same. This reduces the toner run cost proportionally to the TMA reduction. The thinner toner layers also result in more of an offset look and feel for the print, as offset inks produce thin image layers on the print.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

A highly pigmented Ultra Low Melt emulsion aggregation magenta toner was prepared with a reactive coalescent as follows. VELTA® 262 Coalescent (isodecyl benzoate) was utilized as the coalecing agent.

A core toner slurry was prepared in a 2 liter glass reactor which included two amorphous polyester resin emulsions (at a ratio of about 50:50). One emulsion included about 150 grams of a low molecular weight resin including an alkoxylated bisphenol A with terephthalic acid, fumaric acid, and dodecenylsuccinic acid co-monomers, and the other emulsion included about 150 grams of a high molecular weight resin including alkoxylated bisphenol A with terephthalic acid, trimellitic acid, and dodecenylsuccinic acid co-monomers.

Also added thereto was about 58 grams of a crystalline resin emulsion of the following formula:

(II)

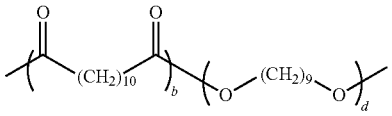

wherein b was from about 5 to about 2000 and d was from about 5 to about 2000, about 2 pph of DOWFAX™ 2A1, an alkyldiphenyloxide disulfonate available commercially from The Dow Chemical Company, about 110 grams of Pigment Red 122 (PR122) pigment, in a dispersion, about 110 grams of Pigment Red 269 (PR269) pigment, in a dispersion, and about 85 grams of a polyethylene wax (from IGI) in a dispersion. The crystalline resin was present in an amount of about 6.7% by weight of the toner, the PR122 was present in an amount of about 6.525% by weight of the toner, and the PR269 was present in an amount of about 6.525% by weight of the toner, and the wax was present in an amount was present in an amount of about 9% by weight of the toner. The low molecular weight and the high molecular weight amorphous resins were each present in an amount of about 36% by weight of the toner. The components were mixed and then the pH was adjusted to 4.2 using 0.3M nitric acid.

The slurry was homogenized at a speed from about 3000 revolutions per minute (rpm) to about 6000 rpm while adding about 5.1 grams of aluminum sulfate as a coagulant over a period of about eight minutes.

The toner slurry was then aggregated at about 850 rpm at a temperature of around 48° C. for a period of about 40 minutes. During aggregation, the toner particle size was closely monitored. At around 4.8 microns in size, a shell including the same amorphous emulsions as in the core (ratio of the two amorphous resins was about 50:50) was added to achieve the final targeted particle size of about 5.8 microns. After the particle size was obtained, the pH of the slurry was about 4.2. The pH was then adjusted using sodium hydroxide (NaOH), and ethylene diamine tetraacetic acid (EDTA) (commercially available as VERSENE-100 from the Dow Chemical Company) to obtain a pH of about 7.2, at which time additional sodium hydroxide was added to obtain a pH of about 7.8, and kept there for about 10 minutes.

About 0.4 grams of VELTA® 262 Coalescent (isodecyl benzoate) was added to the slurry and held for about 20 minutes. The temperature of the mixture was increased to about 82° C. over a period of about 35 minutes, while maintaining a pH of greater than or equal to 7.5 until the reactor temperature (Tr) was about 82° C. Once the Tr reached 82° C., the pH of the toner slurry was reduced to about 7 using 0.3M nitric acid and held under these conditions for about 3 hours. After the toner coalesced to form particles, the toner was cooled.

The toner had a volume average particle diameter (D50) of about 6.11 microns and a circularity of about 0.976. After washing with deionized water and freeze drying, the final toner product had Volume Average Geometric Size Distribution (GSDv) of about 1.21, a Number Average Geometric Size Distribution (GSDn) of about 1.20, a D50 of about 5.74 microns, and a circularity of about 0.973.

Comparative Example 1

Magenta toner particles were prepared using the same formulation and process described above in Example 1, except that no reactive coalescent was added, and a higher coalescence temperature (85° C.) and coalescence time (5 hours) was utilized.

The resulting toner particles had a circularity, 0.971, after 5 hours, with a particle size (D50) of about 5.71 microns, a GSDv of about 1.23, and a GSDn of about 1.23. Comparisons between the reaction conditions and properties of the particles of Example 1 and this Comparative Example 1 are set forth below in Tables 1 and 2:

TABLE 1

| Sample | Coalescent | Particle Size (um) | GSDv | Circularity |
|---|---|---|---|---|
| Example 1 | VELTA ® 262 | 5.74 | 1.21 | 0.973 |
| Comparative Example 1 | None | 5.71 | 1.23 | 0.971 |

TABLE 2

| Sample | Coalescence Temp. (° C.) | Coalescence time (hours) | BET (multi point) ($m^2/g$) | Tg (° C.) |
|---|---|---|---|---|
| Example 1 | 82 | 3 | 1.21 | 51.3 |
| Comparative Example 1 | 85 | 5 | 1.52 | 51.7 |

BET = surface area of the toner particles (determined by the BET method)
Tg = glass transition temperature As can bee seen from the above, compared with the process that did not utilize the reactive coalescence agent (Comparative Example 1), the process of the present disclosure, utilizing a small amount of reactive coalscent agent (Example 1), had a significantly reduced time for coalescence (3 hours coalescence to obtain a 0.973 particle circularity, compared with 5 hours coalescence to obtain a circularity of 0.971), about a 40% reduction in time, at a lower coalescence temperature (82° C. instead of 85° C.). The resulting toner particles also showed improved GSD and BET. The Tg was almost the same as the toner particle prepared without the reactive coalescent agent, indicating that the impact of the small amount of the reactive coalescent agent was minimal on other toner properties.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting at least one amorphous resin in an emulsion, at least one crystalline resin in an emulsion, a colorant dispersion, and a wax to form a mixture;

aggregating the mixture to form aggregated particles;

adding a reactive coalescent agent selected from the group consisting of benzoic acid alkyl esters, ester-alcohols, glycol-ether type solvents, long-chain aliphatic alcohols, aromatic alcohols, and mixtures thereof to the aggregated particles;

allowing the aggregated particles to coalesce for a period of time of from about 10 minutes to about 300 minutes to form toner particles; and recovering the toner particles, wherein the toner particles are highly pigmented particles possessing the colorant in an amount of from about 1 percent by weight to about 15 percent by weight of the toner particles, and wherein the particles exhibit a BET of about 1.21 $m^2/g$.

2. The process of claim 1, wherein the amorphous resin comprises an amorphous polyester resin comprising an alkoxylated bisphenol A fumarate/terephthalate based polyester or copolyester resin.

3. The process of claim 1, wherein the crystalline resin is of the formula:

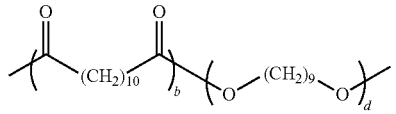

(II)

wherein b is from about 5 to about 2000 and d is from about 5 to about 2000.

4. The process of claim 1, wherein aggregating the mixture occurs in the presence of an aggregating agent selected from the group consisting of polyaluminum halides, polyaluminum silicates, and water soluble aluminum salts.

5. The process of claim 1, wherein the reactive coalescent agent comprises a benzoic acid alkyl ester selected from the group consisting of decyl benzoate, isodecyl benzoate, nonyl benzoate, isononyl benzoate, octyl benzoate, isooctyl benzoate, 2-ethylhexyl benzoate, tridecyl or isotridecyl benzoate, 3,7-dimethyloctyl benzoate, 3,5,5-trimethylhexyl benzoate, and combinations thereof.

6. The process of claim 1, wherein the reactive coalescent agent comprises an ester-alcohol comprising an hydroxyalkyl ester of alkanoic acids.

7. The process of claim 1, wherein the reactive coalescent agent comprises a glycol-ether solvent selected from the group consisting of diethylene glycol monomethylether acetate, diethylene glycol monobutylether acetate, butyl carbitol acetate, and combinations thereof.

8. The process of claim 1, wherein the reactive coalescent agent comprises a long-chain aliphatic alcohol possessing alkyl groups having from about 5 to about 20 carbon atoms.

9. The process of claim 1, wherein the reactive coalescent agent has a solubility in water of below about 0.5 weight %.

10. The process of claim 1, wherein the toner particles possess the colorant in an amount of from about 2 percent by weight to about 12 percent by weight of the toner particles.

11. A process comprising:

contacting at least one amorphous resin in an emulsion, at least one crystalline resin in an emulsion, a colorant dispersion, and a wax to form a mixture;

aggregating the mixture in the presence of an aggregating agent selected from the group consisting of polyaluminum halides, polyaluminum silicates, and water soluble aluminum salts, to form aggregated particles;

adding a reactive coalescent agent selected from the group consisting of benzoic acid alkyl esters, ester-alcohols, glycol-ether type solvents, long-chain aliphatic alcohols, aromatic alcohols, and mixtures thereof to the aggregated particles;

allowing the aggregated particles to coalesce for a period of time of from about 10 minutes to about 300 minutes to form toner particles; and recovering the toner particles, wherein the toner particles are highly pigmented particles possessing, the colorant in an amount of from about 1 percent by weight to about 15 percent by weight of the toner particles, wherein the toner particles possess a melting point of from about 50° C. to about 100° C., and wherein the particles exhibit a BET of about 1.21 $m^2/g$.

12. The process of claim 11, wherein the at least one amorphous resin comprises a high molecular weight resin including alkoxylated bisphenol A with terephthalic acid, trimellitic acid, and dodecenylsuccinic acid co-monomers, having a weight average molecular weight from about 45,000 to about 150,000, in combination with a low molecular weight resin including alkoxylated bisphenol A with terephthalic acid, fumaric acid, and dodecenylsuccinic acid co-monomers, having a weight average molecular weight from about 500 daltons to about 10,000 daltons.

13. The process of claim 11, wherein the crystalline resin is of the formula:

(II)

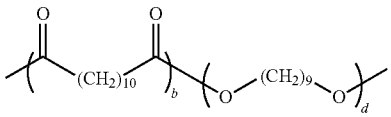

wherein b is from about 5 to about 2000 and d is from about 5 to about 2000.

14. The process of claim 11, wherein the reactive coalescent agent comprises a benzoic acid alkyl ester selected from the group consisting of decyl benzoate, isodecyl benzoate, nonyl benzoate, isononyl benzoate, octyl benzoate, isooctyl benzoate, 2-ethylhexyl benzoate, tridecyl or isotridecyl benzoate, 3,7-dimethyloctyl benzoate, 3,5,5-trimethylhexyl benzoate, and combinations thereof.

15. The process of claim 11, wherein the reactive coalescent agent comprises a glycol-ether solvent selected from the group consisting of diethylene glycol monomethylether acetate, diethylene glycol monobutylether acetate, butyl carbitol acetate, and combinations thereof.

16. The process of claim 11, wherein the reactive coalescent agent has solubility in water of below about 0.5 weight %.

17. A process comprising:

contacting at least one amorphous resin in an emulsion, at least one crystalline resin in an emulsion, a colorant dispersion, and a wax to form a mixture;

aggregating the mixture in the presence of an aggregating agent selected from the group consisting of polyaluminum halides, polyaluminum silicates, and water soluble aluminum salts, to form aggregated particles;

adding a reactive coalescent agent comprising a benzoic acid alkyl ester selected from the group consisting of decyl benzoate, isodecyl benzoate, nonyl benzoate, isononyl benzoate, octyl benzoate, isooctyl benzoate, 2-ethylhexyl benzoate, tridecyl or isotridecyl benzoate, 3,7-dimethyloctyl benzoate, 3,5,5-trimethylhexyl benzoate, and combinations thereof, to the aggregated particles;

allowing the aggregated particles to coalesce for a period of time of from about 10 minutes to about 300 minutes to form toner particles; and recovering the toner particles, wherein the toner particles are highly pigmented particles possessing the colorant in an amount of from about 1 percent by weight to about 15 percent by weight of the toner particles, wherein the toner particles possess a melting point of from about 50° C. to about 100° C., and wherein the particles exhibit a BET of about 1.21 $m^2/g$.

18. The process of claim 17, wherein the at least one amorphous resin comprises a high molecular weight resin including alkoxylated bisphenol A with terephthalic acid, trimellitic acid, and dodecenylsuccinic acid co-monomers, having a weight average molecular weight from about 45,000 to about 150,000, in combination with a low molecular weight resin including alkoxylated bisphenol A with terephthalic acid, fumaric acid, and dodecenylsuccinic acid co-monomers, having a weight average molecular weight from about 500 daltons to about 10,000 daltons.

19. The process of claim 17, wherein the crystalline resin is of the formula:

(II)

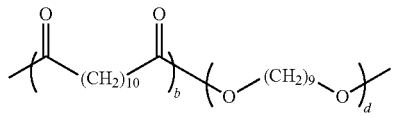

wherein b is from about 5 to about 2000 and d is from about 5 to about 2000.

20. The process of claim 17, wherein the reactive coalescent agent has solubility in water of below about 0.5 weight %.

* * * * *